United States Patent [19]

Brzostek

[11] 4,210,380

[45] Jul. 1, 1980

[54] CABLE CONNECTOR HOUSING HAVING STRAIN RELIEF SYSTEM

[75] Inventor: Melvin W. Brzostek, Bel Air, Md.

[73] Assignee: Western Electric Company, Inc., New York, N.Y.

[21] Appl. No.: 959,040

[22] Filed: Nov. 8, 1978

[51] Int. Cl.[2] ..... H01R 13/58

[52] U.S. Cl. ..... 339/107; 339/101

[58] Field of Search ..... 339/107, 105, 104, 103, 339/101

[56] References Cited

U.S. PATENT DOCUMENTS

| | | | |
|---|---|---|---|
| 3,909,101 | 9/1975 | Bruels | 339/107 |
| 3,920,306 | 11/1975 | Barnett, Jr. et al. | 339/107 X |

FOREIGN PATENT DOCUMENTS

| | | | |
|---|---|---|---|
| 29185 | 10/1931 | Australia | 339/105 |

*Primary Examiner*—Roy Lake

*Assistant Examiner*—DeWalden W. Jones

*Attorney, Agent, or Firm*—E. W. Somers

[57] ABSTRACT

One end of a cable (12) is assembled to a connector (11) which is supported in a housing (10), and extends along a path through a cable entrance end (32) of the housing. The housing includes two mateable portions (25, 26) with one portion having a base (31) which includes a plurality of posts (50—50) projecting therefrom in a predetermined pattern between the connector and the cable entrance end to provide a plurality of cable paths through the housing. Each cross-sectional size cable within a range has an associated path with posts along the path engaging the cable to provide suitable strain relief therefor. Advantageously, the posts not only provide suitable strain relief for any cable within a range of cross-sectional sizes, but they also cooperate with openings (70—70) in the other portion of the housing to secure the two portions together.

5 Claims, 3 Drawing Figures

CABLE CONNECTOR HOUSING HAVING STRAIN RELIEF SYSTEM

TECHNICAL FIELD

This invention relates to a cable connector housing having a cable strain relief system, and, more particularly, to a housing for a multi-conductor cable and connector assembly which includes a strain relief system for the cable that is adaptable to any one of a range of cable cross sections.

BACKGROUND OF THE INVENTION

In the communications industry, provisions for connecting a telephone instrument to a data transmitting console includes a plastic, e.g. polyvinyl chloride (PVC), jacketed cable, having a plurality of conductors, that is connected at one of its ends to a telephone instrument through a well known micro-ribbon connector such as is shown, for example, in U.S. Pat. Nos. 3,760,335 and 3,758,935. At its other end, the cable is connected to contact pins received in apertures of a multi-contact connector which is adapted to be plugged into a mating connector on the console. This particular multi-contact type of connector, which is referred to as a sub-miniature connector, is adapted to be supported within a housing through which the cable is routed to an opening in an opposite end of the housing and thence to the telephone instrument.

Any one of a number of different size cross-section cables is used with the same size housing with the smaller ones utilizing only a portion of the total number of apertures which are available in the connector. Of course, as the number of conductors of the same gauge in the cable increases, more of the apertures in the connector are used and the size of the cable increases.

It is customary to provide strain relief facilities to prevent the detachment of one or more of the conductors from a connector during use. The micro-ribbon type connector on the telephone instrument side typically includes a strain-relief band which is an integral part of the connector. However, strain relief for the different size cables on the console end has been provided by a wing clamp near the cable entrance end of the housing because the configuration of the connector itself precludes the use of an integral band such as that used with the micro-ribbon connector. Since any number of different size cables may be used, it is necessary to maintain an inventory of different size clamps which can be used with the different size cables.

A housing which not only provides a mounting for the connector but one which also provides strain relief for a number of different size cables without the use of separate metal clamps would be most desirable. Another desirable attribute of a housing is that a cable may be routed therethrough with relative ease since the connector is already assembled to the cable when it is mounted in the housing.

In the prior art such as that of strain relief systems in telephone cord connectors, for example, U.S. Pat. No. 3,699,498, issued Oct. 16, 1972 to E. C. Hardesty et al, shows a telephone cord routed through a tortuous path which is defined between two mating portions of a connector commonly known as a modular plug. It is also common for routineers in the art to use metal type clamps for engaging the jack of a small pair size cable to provide strain relief for the cable during use. See, for example, U.S. Pat. No. 3,758,935 which covers the familiar micro-ribbon connector, as well as U.S. Pat. Nos. 3,966,293 and 4,095,870 which show other strain relief systems.

SUMMARY OF THE INVENTION

The foregoing problems have been solved by a housing made in accordance with this invention which supports a connector and which provides strain relief for a multi-conductor cable within a range of different size cables that is assembled to the connector. The housing of the invention includes a first portion having a cable entrance end and a connector input end and which includes a base having a plurality of posts projecting therefrom in a predetermined pattern between said cable entrance end and said connector-input end. The pattern of posts provides a plurality of cable paths each of which extends from said entrance end to said input end with each particular size cable within a range of sizes having an associated path. The housing also includes a second portion which is mateable with the first portion to cooperate with the first portion in providing a mounting for the connector adjacent the input end and an enclosure for the cable which extends from the connector along its associated path about the posts to the cable entrance end.

The second portion also includes a plurality of openings which are made in accordance with the predetermined pattern of posts so that when the portions are mated together, the posts are received in the openings and snap-locked therein to secure the two portions together. A wall which depends from each portion has an opening formed therein with both the openings cooperating to form an aperture for receiving any one of a number of size cables. Also, when the portions are mated together, unwalled lengths of the first and second portions cooperate to form an opening for receiving and mounting the conductor side of a multi-conductor connector.

In accordance with this invention, the projecting posts are used to define a tortuous path for a cable to provide suitable strain relief for the cable with the tortuous path predetermined according to the number of conductors and cross-section of the cable. Advantageously, the posts which project from the base perform a dual function-they cooperate with the openings in the second portion to cause a snap-locking together of the mating portions, and serve as posts about which a cable is routed in an associated one of a plurality of paths, depending on cable size, in order to provide suitable strain relief for the cable.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
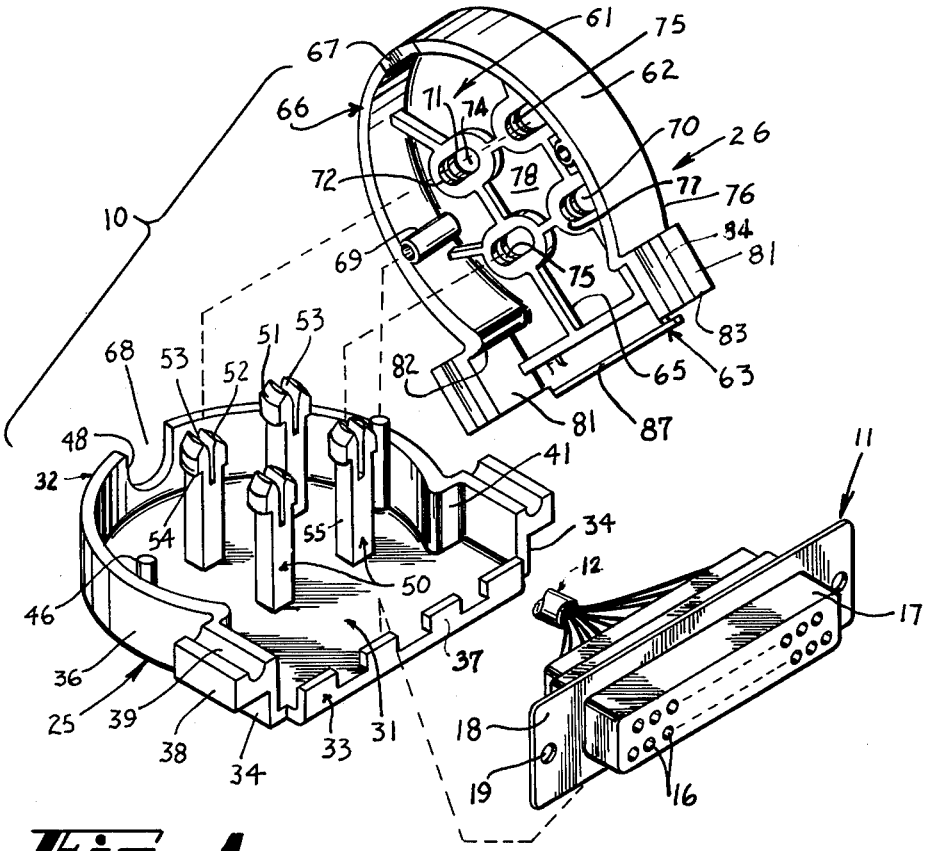
FIG. 1 is an exploded perspective view of a housing which is constructed in accordance with the principles of this invention which supports a multi-contact connector and which provides strain relief for a cable that is assembled to the connector.

Referring now to FIG. 1 there is shown an exploded perspective view of a housing, designated generally by the numeral 10, for holding a connector 11, which is plugged into apparatus (not shown) and connected through a cable, designated generally by the numeral 12, to a telephone instrument (not shown). In one environment, the connection of the cable 12 is made to the telephone instrument through a micro-ribbon type connector such as that shown, foı example in U.S. Pat. No. 3,758,935. Micro-ribbon type connectors typically are constructed with facilities such as a wing clamp for providing strain relief for the cable; however, the connector 11 as depicted in FIG. 1 does not include such facilities. The housing 10 provides strain relief for any size cable 12 within an expected range which is assembled to the connector 11.

The cable 12 includes a plurality of individually insulated conductors 13—13 (see FIG. 2) that are enclosed in a jacket 14 which is made of a plastic material such as, for example, polyvinyl chloride. The cable 12 which is expected to be routed through the housing 10 of this invention may include as few as six conductors 13—13 or may have a number as high as twenty-six with an outside cable jacket of a diameter ranging between 0.5 cm and 0.76 cm, respectively. For purposes of this description, cable size is intended to mean the outer diameter or cross-sectional size of the jacketed cable 12 which increases or decreases depending upon the number of insulated conductors 13—13 enclosed by the jacket 14.

The connector 11 which is to be mounted in the housing 10 is a multi-conductor connector, commonly referred to as a sub-miniature connector and having a plurality of apertures 16—16 extending through an elongated plastic body 17 thereof. Metal ears 18—18 extend from the plastic body 17 and have openings 19—19 therein to facilitate the screw-mounting, for example, of the connector and the housing 10 to apparatus (not shown), such as, for example, a data transmitting console. The attachment of the connector 11 and the housing 10 to the console, for example, causes the connector to be connected electrically to a mating connector. In one embodiment, each of the conductors 13—13 is terminated with a pin (not shown) which is inserted into a designated one of the apertures 16—16. For any given size cable 12, some of the apertures 16—16 may not be used. In other embodiments, the conductors 13—13 may be assembled to bifurcated type contact elements of the type shown in U.S. Pat. No. 3,772,635, , for example, or may be soldered to contacts of the connector itself.

The housing 10 includes two mateable portions 25 and 26 made from a suitable plastic material such as, for example, polycarbonate. As can be seen in FIG. 1, the portion 25, which will hereinafter be referred to as the first portion, includes a base 31 having one end 32 which is generally curved and another end 33 which extends generally linearly between two sides 34—34. The ends 32 and 33 are appropriately referred to as the cable entrance and the connector-input ends, respectively. The first portion 25 also includes a wall 36 upstanding from the periphery of the base 31 along the end 33 and along the sides 34—34 but not along the end 33. Instead, the end 33 is formed with a plurality of spaced teeth 37—37 which protrude upwardly from the base 31. In order to permit the cable 12 access to the connector 11 which is mounted to the housing 10, the wall 36 is formed with a generally semi-circular opening 48 along the entrance end 32.

Further, as can be seen in FIG. 1, the first portion 25 includes an ear 38 laterally extending from the wall 36 adjacent each side 34. The ear 38 includes a generally semi-circular groove 39 which is destined to cooperate with structural elements of the second portion 26 for receiving a threaded fastener turned through one of the openings 19—19 of the connector 11. The wall 36 is joined to the ears 38—38 through offset portions 41—41 which cooperate with the sides 34—34 under the ears and with the teeth 37—37 to form a partial enclosure for the connector 11.

In order to facilitate the mating of the portions 25 and 26, a pair of pins 46—46 extend upwardly from the base 31 adjacent the wall 36. These pins 46—46 function as guides to align the second portion 26 with the first portion 25 and thereby also align strain relief facilities of the portions.

In order to provide strain relief for a cable 12 which extends through the housing 10, the first portion 25 further includes a plurality of posts 50—50 upstanding from the base 31. Each of the posts 50—50 has a shank 55 of generally square cross-section and a free end 51 which is bifurcated to form furcations 52—52. The furcations 52—52 which form a slot 53 therebetween may be urged toward each other by the application of forces to the free upper end 51. Each of the furcations 52—52 is chamfered or rounded adjacent its upper free end to facilitate the entry of the free end of the post into an appropriately sized aperture in the portion 26. Further, the chamfered or rounded portion of each furcation 52 is formed with an undercut 54 which connects the chamfered portion to the shank 55.

The arrangement of the posts 50—50 on the base 31 in the pattern shown provides a plurality of tortuous routes or paths for a cable 12 which extends from the connector 11 through the entrance end 32 of the housing 10. The pattern of the posts 50—50 is predetermined so that each size cable within a preset range of cable sizes is associated with one of the paths. The routing of a cable 12 about the posts 50—50 in its associated tortuous path predetermined according to the size of the cable provides suitable strain relief for the cable during use of the equipment to which it and the connector are attached.

Turning now to the portion 26, which will hereinafter be referred to as the second portion, it can be seen that a cover 61, which is reinforced by ribs 65—65, has a shape which is congruent with the base 31 of the first portion 25. The second portion 26 also has a wall 62 depending from the cover 61 and from a generally semi-circular end 66 but not across a front end 63. The wall 62 along the semi-circular end 66 is formed with a semi-circular opening 67 which cooperates with the semi-circular opening 48 in the first portion 25 to form a circular opening 68 that is capable of receiving the largest outside diameter cable 12 that expected to be used with the housing 10. As can also be seen in FIG. 1, the second portion 26 has two sleeves 69—69 for receiving the pins 46—46 of the first portion 25.

The cover 61 of the second portion 26 is formed with a plurality of apertures 70—70 which are aligned with the posts 50—50 when the pins 46—46 are received in the sleeves 69—69 and the first and second portions 25 and 26 assembled together to form the housing 10. In a preferred embodiment, each of the apertures 70—70 is elongated and has two side walls 71—71 joined at their ends by arcuate portions 72—72. In order to retain the undercut portions 54—54 of the posts 50—50 when they are inserted into the apertures, the arcuate portions 72—72 are stepped along a ledge 75 with an enlarged portion 74 opening to an outer surface 76 of the cover 61 and a narrow portion 77 opening to an inwardly facing surface 78.

The second portion 26 also has walls 81—81 depending from the cover 61 and connected to the wall 62 by offset portions 82—82. The walls 81—81 include ears 83—83 extending laterally therefrom with each ear having a generally semi-circular groove 84. When the portions 25 and 26 are mated together, the grooves 84—84 and the grooves 39—39 in the first portion cooperate to receive fasteners (not shown) that are turned through the openings 19—19 in the connector 11 to secure it to the housing 10.

Moreover, the open front end 63 of the second portion 26 is adapted to cooperate with the open front end 33 of the first portion 25 when the portions are assembled to form a generally rectangular opening for receiving the connector 11 with the cable 12 extending therefrom. The second portion 26 has a lip 87 depending downwardly from the cover 63 across the end 63 thereof which together with the teeth 37—37 engage the plastic body portion 17 to provide additional support for the connector 11.

Figure 2:
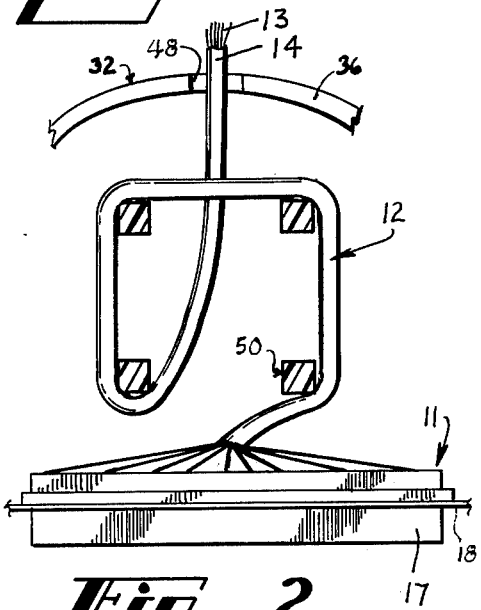
FIG. 2 is a plan view of a base of one portion of the housing which includes a plurality of upstanding posts and shows one pattern of the posts in cross-section and a path of the cable to provide strain relief therefor.
Figure 3:
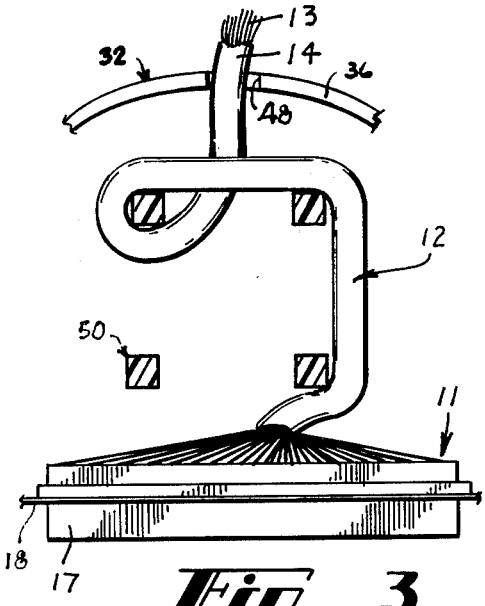
FIG. 3 is another plan view of the base of the housing showing a path for another size cable.

In use, the connector 11 having a cable 12 of a particular size attached thereto is positioned in the front end 33 of the first portion 25 with the plate 18 abutting the teeth 37—37 and the apertures 19—19 aligned with the grooves 39—39 in the ears 38—38. Then the cable 12 is routed about the posts 50—50 in a path which is predetermined in accordance with the size cable. With the range of cable sizes presently anticipated, two patterns of routing of the cable 12 about the posts 50—50 are used and are shown in FIGS. 2 and 3. The path in FIG. 2 is used for all size cables 12—12 within the hereinbefore stated range, except the 26 conductor cable which follows the route shown in FIG. 3. It is of course understood that other routing patterns in tortuous paths about the posts 50—50 and indeed other arrangements of the posts or numbers thereof could be used and yet be within the scope of this invention. The square cross-section of the shanks 55—55 effectively causes edges thereof to bite into the cable jacket 14 as the cable is routed therearound to secure the cable within the pattern.

Once the predetermined path is selected and the cable 12 routed in accordance therewith, the cable is then passed through the semi-circular opening 48 in the first portion 25. Then the second portion 26 is assembled to the first portion 25 by guiding the pins 46—46 to enter the sleeves 69—69 which causes the posts 50—50 to enter the stepped apertures 70—70 in the cover 61. As the second portion 26 is urged toward the first, the free end portions 51—51 of the posts 50—50 are compressed, then spring open in the enlarged portions 74—74 of the openings to snap-lock the two portions together. The undercut 54 of each post 50 engages with the ledge 75 of its associated aperture 70 in the cover 61.

Advantageously, the posts 50—50 serve a dual function for the connector housing 10. Not only do they provide a plurality of available tortuous paths from which one is selected for a particular size cable 12 to provide strain relief, but they also serve to secure together the mateable portions 25 and 26. In fact, because of the snap-locking together of the portions 25 and 26, special tooling (not shown) is required which simultaneously engages the chamfered surfaces of each post and cams them together to permit the second portion 26 to be moved out of engagement with the first portion.

Also, the semi-circular opening 67 of the second portion 26 completes the enclosure of the cable 12 extending through the cable entrance end of the housing 10. The housing 10 provides a support for mounting the connector 11 and provides strain relief for the cable 12 while enclosing the tortuous path of the cable, thereby providing a more pleasing appearance for the assembly.

EXAMPLE

In a housing 10 which includes a strain relief system for cables 12—12 having an outside diameter in the range of about 0.5 cm to 0.76 cm, the first portion 25 has an overall length of about 4.3 cm and an overall width of about 5.4 cm. The sides 34—34 are spaced apart about 4.2 cm with the wall 36 being about 0.7 cm high and the opening 48 having a radius of about 0.11 cm. Each of the posts 50—50 has a square cross-section shank 55 which measures about 0.47 cm on a side and has an overall height of about 1.8 cms. The slot 53 in each post 50 is about 0.23 cm in width and extends about 0.76 cm from the top while the undercut 54 extends about 0.14 cm out from the shank 55. The posts 50—50 are arranged in a pattern such that each is at the corner of a square with about 1.3 cms between adjacent corners with the pattern of posts beginning about 0.6 cm from the opening 48 and about 1.3 cms from the teeth 37—37. The cover 61 of the second portion 26 has a thickness of about 0.36 cm excluding the ribs 65—65. Each of the apertures 70—70 has an overall length of about 0.52 cm and an overall width of about 0.5 cm with the radius of the arcuate portions 72—72 being about 0.25 cm. The distance from the outer surface 76 of the cover 61 to the ledge 75 of each aperture 70 is about 0.39 cm while the overall depth of each aperture is about a 0.76 cm.

It is to be understood that the above-described arrangements are simply illustrative of the invention. Other arrangements may be devised by those skilled in the art which will embody the principles of the invention and fall within the spirit and scope thereof.

What is claimed is:

1. A housing which provides strain relief for a cable within a range of cross-sectional sizes which is assembled to a connector that is mounted to the housing, said housing comprising:

a first portion having a cable entrance end and a connector-input end and which includes a base having a plurality of posts each having a slotted free end and projecting therefrom in a predetermined pattern between said cable entrance end and said input end, said pattern providing a plurality of cable paths which extend from said entrance end to said input end with a predetermined path for each cross-sectional size cable within a range of sizes which causes engagement of the cable with one or more of said posts to provide suitable strain relief for the cable during use; and a second portion being mateable with the first portion to provide a mounting for the connector adjacent the input end and to provide an enclosure for a cable which extends from the connector along its predetermined path about the posts to the cable entrance end, said second portion including a cover having a plurality of apertures therethrough which are adapted to receive the posts when said portions are mated together, said apertures in the cover being stepped with a ledge formed between a smaller portion and a larger portion, said larger portion of each aperture opening to an external surface of the cover, said posts being such that when the portions are mated together, the slotted free end of each post is moved into an associated aligned aperture, is compressed, and as the slotted end of each post is moved into the larger portion of each aperture, it expands and snap-locks above the ledge to secure the portions together.

2. The housing of claim 1, wherein the cable includes a plurality of conductors that are enclosed in a common plastic jacket and said posts have a rectangular cross-section with edges thereof biting into the cable jacket to anchor the cable within the housing.

3. The housing of claim 1, wherein the first portion includes a wall projecting from a peripheral edge of the base, said wall having an opening for the cable at the cable entrance end and being discontinuous along said connector-input end, said second portion including a wall projecting from the cover and having an opening at one of its ends to cooperate with the opening in the first portion to receive any cable within said range, said wall being discontinuous along the other end to cooperate with the open end of the first portion to receive a connector having a cable extending therefrom and routed along a path associated with its cross-sectional size and through said cable entrance end.

4. A connector for terminating a multi-conductor cable and having a strain relief system to prevent undue stressing of the cable, which comprises:

a multi-contact module having a conductor input end and an output side, said module capable of being mounted to a support; and a housing adapted to support said module, said housing having a module side and a cable-input side, and which includes;

a first portion which includes a base having a plurality of posts each having a slotted enlarged free end upstanding therefrom in a predetermined pattern between said module and said cable-input side, said pattern providing a plurality of predetermined tortuous paths for cables within a range of cable sizes; and a second portion mateable with the first, which includes a cover having a plurality of apertures aligned with the posts and adapted to receive the posts, a cable of a size within said range being enclosed in the housing, extending into the cable-input side, then in a predetermined path in engagement with at least one of said posts and to said connector module, said engagement with at least one post providing suitable strain relief for said cable during use, said apertures in the cover being stepped with a ledge formed between a smaller portion of each aperture and a larger portion of each aperture, said larger portion opening to an external surface of the cover, the slotted end of each post being moved into an associated aligned aperture when the portions are mated together and compressed and as the slotted end of each post is moved into the larger portion of each aperture, it expands and snap-locks above the ledge to secure the portions together.

5. A connector cable assembly, which comprises:

a multi-contact module having a conductor-input end and an output side;

a housing which supports said module, said housing having a module end and a cable-input end, and which includes;

a first portion which includes a base having a plurality of posts each having a slotted, enlarged free end and upstanding therefrom in a predetermined pattern between said module end and said cable-input end, said pattern providing a plurality of tortuous paths associated with cables within a range of cable sizes,; and a second portion mated with the first and which includes a cover having a plurality of apertures with an associated aligned post received in each, said apertures in the cover being stepped with a ledge formed between a smaller portion of such aperture and a larger portion of each aperture opening to an external surface of the cover, the slotted end of each post being moved into an associated aligned aperture when the portions are mated together and compressed, said slotted end of each post expanding as it is moved into the larger portion of each aperture to snap-lock above the ledge and secure the portions together; and a cable having a cross-sectional size within said range which comprises a plurality of individually insulated conductors which are enclosed in a common jacket and which extends into the the cable-input end, then in the associated path in engagement with at least one of said posts, and to said module, said engagement of the cable with said at least one post providing suitable strain relief for said cable during use.

* * * * *